US006170309B1

(12) United States Patent
Marando

(10) Patent No.: US 6,170,309 B1
(45) Date of Patent: Jan. 9, 2001

(54) APPARATUS FOR SIMULTANEOUSLY PERFORMING MULTIPLE HYDROFORMING OPERATIONS

(75) Inventor: Richard A. Marando, Mohrsville, PA (US)

(73) Assignee: Dana Corporation, Toledo, OH (US)

( * ) Notice: Under 35 U.S.C. 154(b), the term of this patent shall be extended for 0 days.

(21) Appl. No.: 09/448,059

(22) Filed: Nov. 23, 1999

(51) Int. Cl.[7] ..... B21D 26/02

(52) U.S. Cl. ..... 72/61; 72/58; 72/404; 72/455; 29/421.1

(58) Field of Search ..... 72/61, 62, 58, 72/404, 455, 456, 472; 10/214; 29/430

(56) References Cited

U.S. PATENT DOCUMENTS

| | | | | |
|---|---|---|---|---|
| 1,844,098 | | 2/1932 | Lytle . | |
| 2,222,762 | * | 11/1940 | Debor et al. | 72/61 |
| 2,331,015 | * | 10/1943 | Dawes et al. | 72/208 |
| 2,476,558 | | 7/1949 | Moxness . | |
| 2,574,892 | | 11/1951 | Schmidt et al. . | |
| 2,869,177 | * | 1/1959 | Jurgeleit | 72/456 |
| 4,026,226 | * | 5/1977 | Hahn et al. | 72/404 |
| 4,355,530 | * | 10/1982 | Chen | 72/452 |
| 4,760,729 | * | 8/1988 | Kaminski | 72/456 |
| 5,073,099 | | 12/1991 | Kayano . | |
| 5,182,121 | | 1/1993 | Miyashita et al. . | |
| 6,006,567 | * | 12/1999 | Brown et al. | 72/58 |
| 6,006,568 | * | 12/1999 | Bihrer | 72/60 |
| 6,018,971 | * | 2/2000 | Kleinschmidt | 72/61 |

* cited by examiner

*Primary Examiner*—David Jones
(74) *Attorney, Agent, or Firm*—MacMillan, Sobanski & Todd, LLC

(57) ABSTRACT

A hydroforming apparatus for simultaneously performing two or more hydroforming operations includes a frame that is sized to support a plurality of hydroforming dies in a stacked relationship. Each of the dies includes a pair of cooperating die sections having respective recesses formed therein that define a die cavity. Initially, the first die section of the first die is positioned in an uppermost spaced apart position relative to the second die section of the second die, while the second die section of the first die and the first die section of the second die are positioned in an intermediate spaced apart position relative to both the first die sect of the first die and the second die section of the second die. Then, hollow tubular blanks are inserted between the spaced apart die sections of the first and second die Next, the ram and the support mechanism are moved downwardly relative to the be such that the pairs of cooperating die sections of the first and second dies engage one another. End feed cylinders are then moved laterally into engagement with the end the tubular blanks to facilitate the filling thereof with a hydroforming fluid. The pressure of the fluid within the tubular blanks is then increased to such a magnitude that the tubular blanks are expanded outwardly into conformance with the respective die cavities. Thus, the hydroforming apparatus is capable of performing two or mo hydroforming operations simultaneously to decrease the overall amount of operational cycle time and, therefore, increase overall productivity.

17 Claims, 5 Drawing Sheets

APPARATUS FOR SIMULTANEOUSLY PERFORMING MULTIPLE HYDROFORMING OPERATIONS

BACKGROUND OF THE INVENTION

This invention relates in general to an apparatus for performing a hydroforming operation on a closed channel workpiece. In particular, this invention relates to an improved structure for such a hydroforming apparatus that is capable of performing two or more hydroforming operations simultaneously to decrease cycle time and increase productivity.

Hydroforming is a well known metal working process that uses pressurized fluid to expand a closed channel workpiece, such as a tubular member, outwardly ir conformance with a die cavity having a desired shape. A typical hydroforming apparatus includes a frame having two die sections that are supported thereon for relative movement between opened and closed positions. The die sections have cooperating recesses formed therein which together define a die cavity having a shape corresponding to a desired final shape for the workpiece. When moved to the opening position, the die sections are spaced apart from one another to allow a workpiece to inserted within or removed from the die cavity. When moved to the closed position the die sections are disposed adjacent to one another so as to enclose the workpiece within the die cavity. Although the die cavity is usually somewhat larger than the workpiece to be hydroformed, movement of the two die sections from the opened position to the closed position may, in some instances, cause some mechanical deformation of the hollow member. In any event, the workpiece is then filled with fluid, typically a relatively incompressible liquid such as water. The pressure of the fluid within the workpiece is increased to such a magnitude that the workpiece is expanded outwardly into conformance with the die cavity. As a result, the workpiece is deformed into the desired final shape. Hydroforming is an advantageous process for forming vehicle frame components and other structures because it can quickly deform a workpiece into a desired complex shape.

In a typical hydroforming apparatus, the two die sections are arranged such that an upper die section is supported on a ram of the apparatus, while a lower die section is supported on a bed of the apparatus. A mechanical or hydraulic actuator is provided for raising the ram and the upper die section upwardly to the opened position relative to the bed and the lower die section, thereby allowing a previously deformed workpiece to be removed from the die cavity and new workpiece to be inserted therein. The actuator also lowers the ram and the upper die section downwardly to the closed position relative to the bed and the lower die section, allowing the hydroforming process to be performed. To maintain the die sections together during the hydroforming process, a mechanical clamping device is usually provided. The mechanical clamping device mechanically engages the die sections (or, alternatively, the ram and the base upon which the die sections are supported) to prevent them from moving apart from one another during the hydroforming process. Such movement would obviously be undesirable because the shape of the die cavity would become distorted, resulting in unacceptable variations in the final shape of the workpiece.

Although known hydroforming apparatuses have been found to function satisfactorily, the use of a single hydroforming die within a single hydroforming apparatus has been found to be somewhat inefficient from a time consumption standpoint. This is because each operational cycle performed by the hydroforming apparatus involves both a preliminary step of filling the article to be hydroformed with the hydroforming fluid prior to performing the hydroforming process, and a subsequent step of emptying the hydroforming fluid from the article after performing the hydroforming process. These filling and emptying steps can consume relatively long periods of time, particularly when the articles to be formed are physically large, as is often the case in the manufacture of vehicle frame components. This inefficiency is further exacerbated when the hydroforming apparatus is used to manufacture products in relatively high volumes, as is also the case in the manufacture of vehicle frame components. Thus, it would be desirable to provide an improved structure for a hydroforming apparatus that is capable of performing two or more hydroforming operations simultaneously to decrease operational cycle time and, therefore, increase overall productivity.

SUMMARY OF THE INVENTION

The invention relates to an improved structure for an apparatus for simultaneously performing two or more hydroforming operations. The hydroforming apparatus includes a frame that is sized to support a plurality of hydroforming dies in stacked relationship. Each of the dies includes a pair of cooperating die sections having respective recesses formed therein that define a die cavity. The first die section of the first die is preferably mounted on or otherwise connected to a movable ram of the hydroforming apparatus for movement therewith. The second die section of the first die is preferably connected to or formed integrally with the first die section of the second die, and the combined assembly is preferably supported on a support mechanism of the hydroforming apparatus for movement therewith. The second die section of the second die is preferably connected to or formed integrally with a stationary bed of the hydroforming apparatus. Initially, the ram is moved upwardly relative to the bed so as to position the first die section of the first die in an uppermost spaced apart position relative to the second die section of the second die. At the same time, the support mechanism is also moved upwardly relative to the bed so as to position the second die section of the first die and the first die section of the second die in an intermediate spaced apart position relative to both the first die section of the first die and the second die section of the second die. Then, hollow tubular blanks are inserted between the spaced apart die sections of the first and second dies. Next, the ram and the support mechanism are moved downwardly relative to the bed such that the pairs of cooperating die sections of the first and second dies engage one another. End feed cylinders are then moved laterally into engagement with the ends of the tubular blanks to facilitate the filling thereof with a hydroforming fluid. The pressure of the fluid within the tubular blanks is then increased to such a magnitude that the tubular blanks are expanded outwardly into conformance with the respective die cavities. Thus, the hydroforming apparatus is capable of performing two or more hydroforming operations simultaneously to decrease the overall amount of operation cycle time and, therefore, increase overall productivity.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
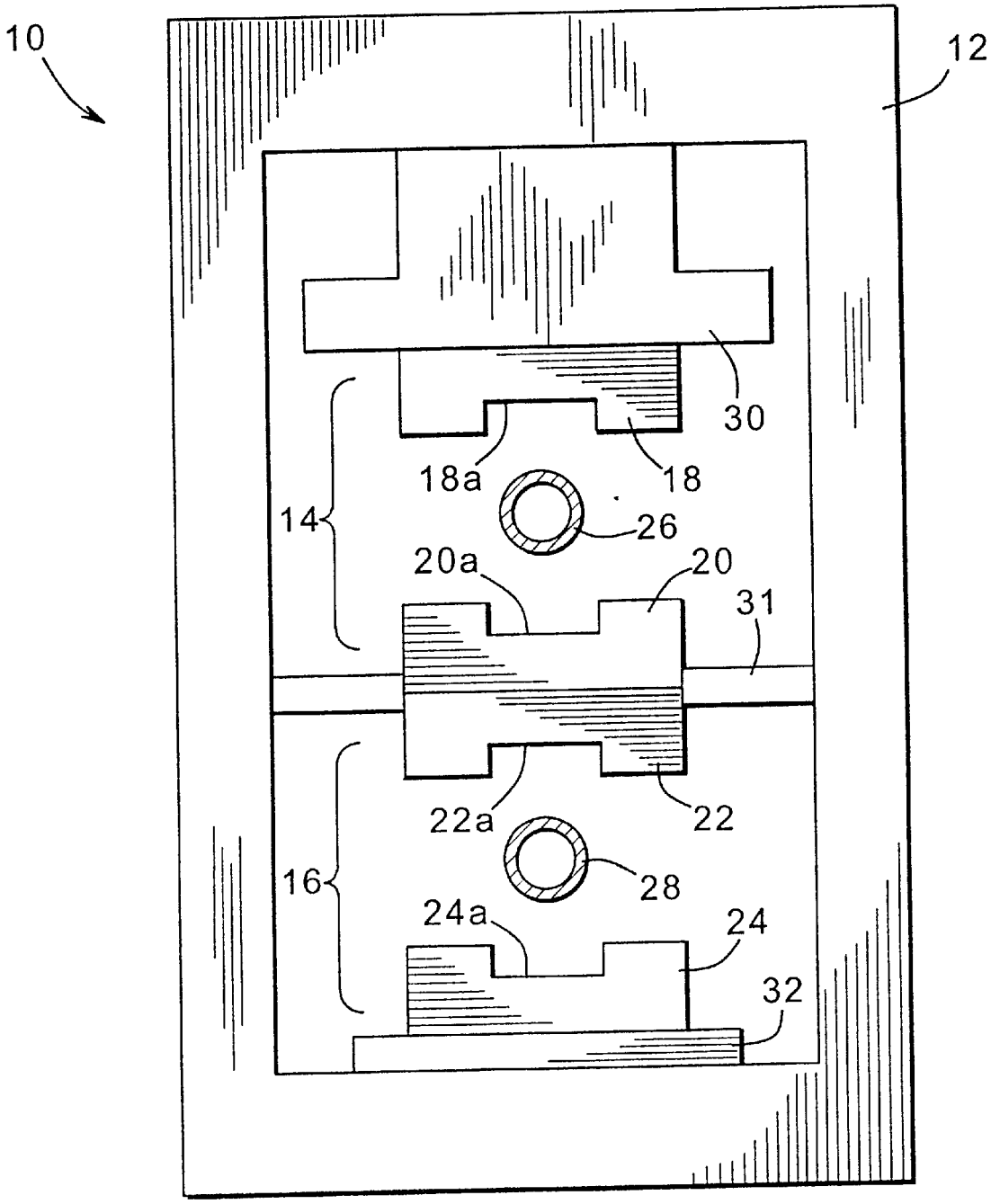
FIG. 1 is a side elevational view of the hydroforming apparatus including a plurality of separate dies in accordance with this invention, wherein the hydroforming apparatus is illustrated in a open position prior to the commencement of an operational cycle of the hydroforming process.

Referring now to the drawings, there is illustrated in FIGS. 1 through 4 an apparatus, indicated generally at 10, for performing a hydroforming process in accordance with this invention. The apparatus 10 includes a frame 12 that is sized to support a plurality of hydroforming dies, two of which are indicated generally at 14 16, in a vertically oriented relationship. Although this invention will be described and illustrated in the context of the two vertically oriented hydroforming dies 14 and 16, it will be appreciated that this invention can be practiced with a greater number of such hydroforming dies if desired. Furthermore, the hydroforming dies 14 and 16 can be oriented within the hydroforming apparatus 10 in any desired direction other than the illustrated vertical direction, such as in the horizontal direction for example.

Figure 2:
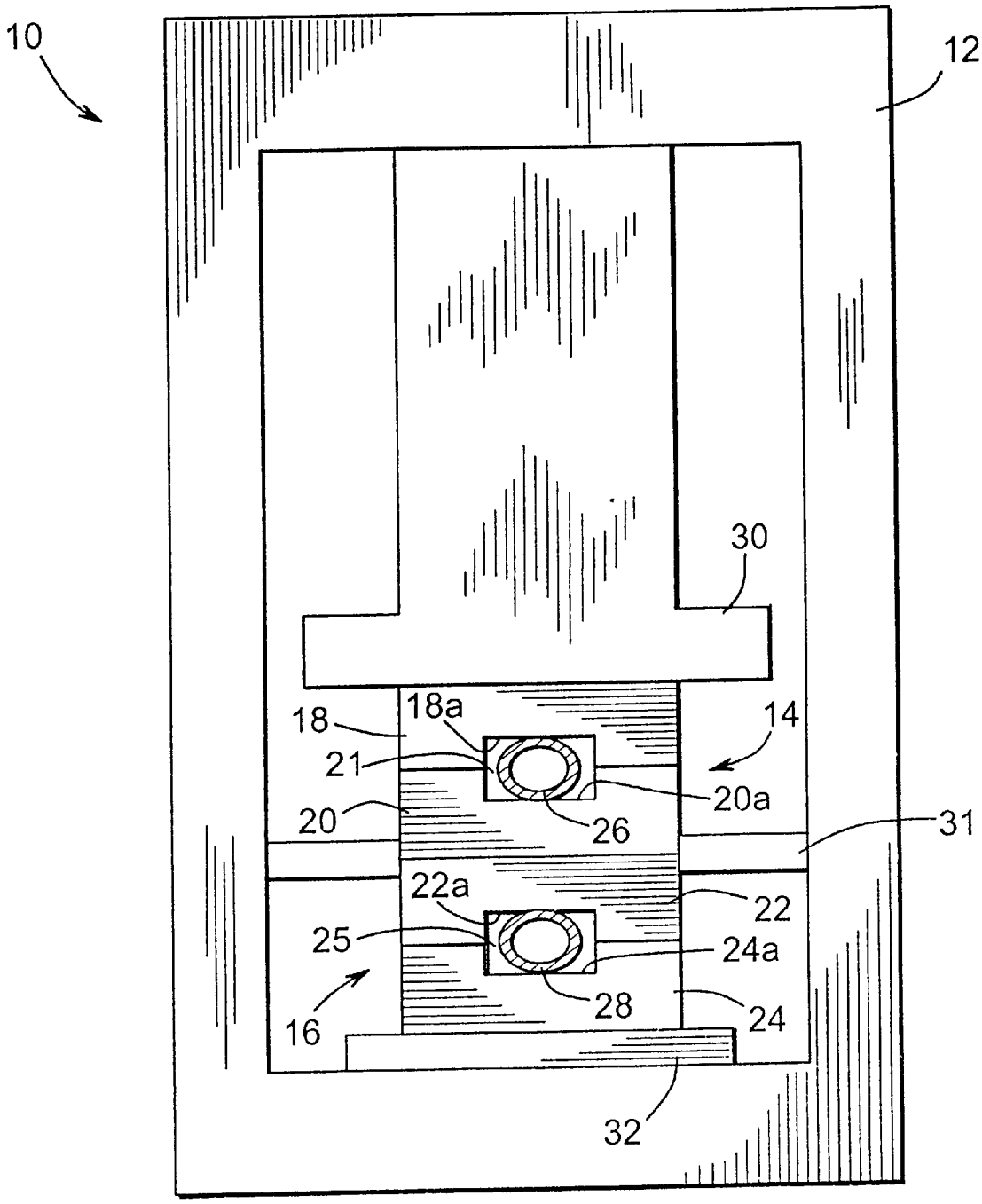
FIG. 2 is a side elevational view of the hydroforming apparatus illustrated in FIG. 1, wherein the hydroforming apparatus is illustrated in a closed position but still prior to the commencement of the hydroforming process.
Figure 3:
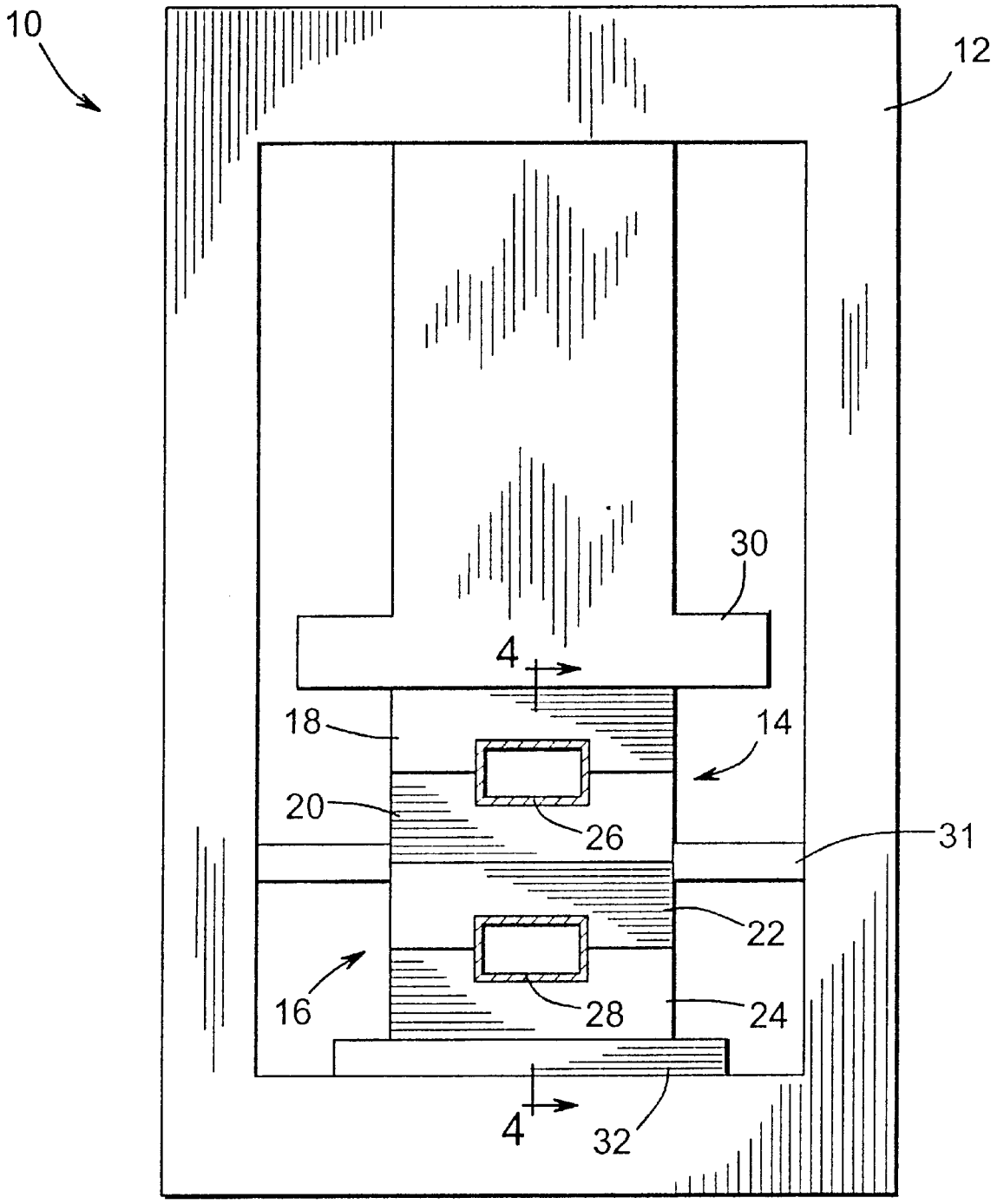
FIG. 3 is a side elevational view of the hydroforming apparatus illustrated in FIG. 1, wherein the hydroforming apparatus is illustrated in the closed position after the commencement of the hydroforming process.

The first die 14 includes a first pair of cooperating die sections 18 and 20 that have respective recesses 18*a* and 20*a* formed therein. When the two die sections 18 and 20 are moved together as shown in FIGS. 2 and 3, the recesses 18*a* and 20*a* formed therein cooperate to define a first die cavity 21 (see FIG. 2). Similarly, the second die 16 includes a second pair of cooperating die sections 22 and 24 that have respective recesses 22*a* and 24*a* formed therein. When the two die sections 22 and 24 are moved together as shown in FIGS. 2 and 3, the recesses 22*a* and 24*a* formed therein cooperate to define a second die cavity 25 (see FIG. 2).

The first die section 18 of the first die 16 is preferably mounted on or otherwise connected to a first portion of the hydroforming apparatus 10, such as a ram 30, for movement therewith. The second die section 20 of the first die 14 is preferably connected to or formed integrally with the first die section 22 of the second die 16. The combined assembly of the second die section 20 of the first die 14 and the first section 22 of the second die 16 is preferably supported on a support mechanism 31 the hydroforming apparatus 10 for movement therewith. Alternatively, if the second die section 20 of the first die 14 and the first die section 22 of the second die 16 are formed as separate pieces, then each may be supported on individual support mechanisms (not shown). Lastly, the second die section 24 of the second die 18 is preferably connected to or formed integrally with a second portion of the hydroforming apparatus 10, such as a stationary bed 32.

Prior to the commencement of an operational cycle of the hydroforming apparatus 10, the various components thereof are oriented in the opened position illustrated in FIG. 1. As shown therein, the ram 30 is moved upwardly relative to the bed 32 so as to position the first die section 18 of the first die 14 in an uppermost spaced apart position relative to the second die section 24 of the second die 18. At the same time, the support mechanism 31 is also moved upwardly relative to the bed 32 so as to position the second die section 20 of the first die 14 and the first die section 22 of the second die 18 in an intermediate spaced apart position relative to both the first die section 18 of the first die 14 and the second die section 24 of the second die 18.

Thereafter, a first hollow tubular blank 26 is inserted between the spaced apart die sections 18 and 20 of the first die 16, and a second hollow tubular blank 28 is inserted between the spaced apart die sections 22 and 24 of the second die 18. The illustrated tubular blanks 26 and 28 are substantially circular in cross-sectional shape. However, it should be understood that the invention is not limited to any specific shape of the tubular blanks 26 and 28, and that the invention can be practiced using hollow members of any shape, as long as they can be disposed within their respective die cavities 21 and 25 prior to the hydroforming operation. The tubular blanks 26 an 28 can be manufactured in any conventional manner, such as by rolling a sheet of metallic material into a complete closed tubular configuration and welding the adjacent edges together. Alternatively, the tubular blanks 26 and 28 can be manufactured as seamless tubes. If desired, the tubular blanks 26 and 28 can be mechanically pre-bent prior to insertion within the first and second dies 16 and 18 so as to approximate the desired final shapes. It will be appreciated that the two die cavities 21 and 25 can be configured to form the tubular blanks 26 and 28 into either the same shape or into two different shapes, as desired.

After the tubular blanks 26 and 28 have been inserted into their respective die cavities 21 and 25, the ram 30 and the support mechanism 31 are moved downwardly relative to the bed 32 to the closed position illustrated in FIG. 2. During such closing movement of the first and second dies 16 and 18, portions of the two tubular blanks 26 and 28 may be mechanically deformed somewhat, as is shown in FIG. 2, although such is not required. When the ram 30 reaches the lowermost position illustrated in FIG. 2, the dies 14 and 16 are disposed in a stacked relationship between the ram 30 and the bed 32. As used herein, the term "stacked relationship" means that the cooperating die sections of each of the dies engage one another, and further that the adjacent die sections of different dies engage one another. Thus, in the illustrated embodiment first pair of cooperating die sections 18 and 20 of the first die 14 engage one another, the second pair of cooperating die sections 22 and 24 of the second die 16 engage one another, and the second die section 20 of the first die 14 engages the first die section 22 of the second die 18. At that time, a conventional clamping mechanism (not shown) can be engaged so as to maintain the die sections 18 and 20 of the first die 14 and the die sections 22 and 24 of the second die 18 in the illustrated stacked relationship. Alternatively, if the hydroforming apparatus 10 is adapted from a conventional mechanical press, the ram 30 can function as the clamping mechanism by moving it to its bottom dead center position illustrated in FIG. 2 so as to urge or otherwise maintain the die sections 18 and 20 of the first die 14 and the die sections 22 and 24 of the second die 18 in the illustrated stacked relationship.

Figure 4:
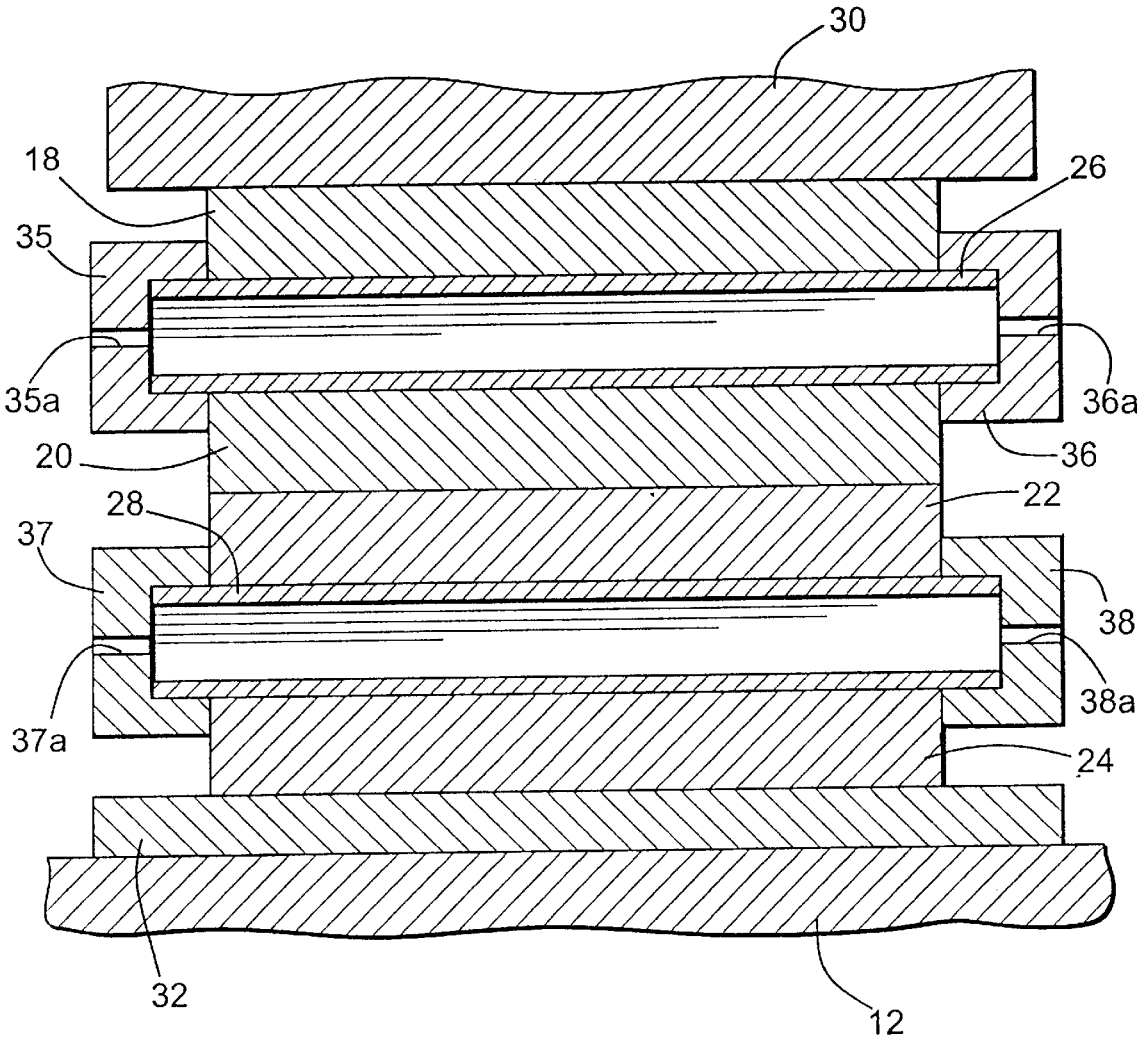
FIG. 4 is an enlarged sectional elevational view of a portion of the hydroforming apparatus taken along line 4—4 of FIG. 3.

Then, a first pair of end feed cylinders 35 and 36 are moved laterally into engagement with the ends of the first tubular blank 26, while a second pair of end feed cylinders 37 and 38 are moved laterally into engagement with the ends of the second tubular blank 28, as shown in FIG. 4. The end feed cylinders 35, 36, 37, and 38 have respective passageways 35*a*, 36*a*, 37*a*, and 38*a* formed therethrough to facilitate the filling and emptying of the tubular blanks 26 and 28 with a hydroforming fluid, typically a relatively incompressible liquid such as water. The illustrated end feed cylinders 35, 36, 37, and 38 are intended to be representative of any mechanism or mechanisms for sealing the ends of the tubular blanks 26 and 28, for supplying pressurized hydroforming fluid into the interiors of the tubular blanks 26 and 28, and for emptying hydroforming fluid from the interiors of the tubular blanks 26 and 28 the conclusion of the hydroforming process.

In the next step of the operational cycle of the hydroforming process, the pressure of the fluid within the tubular blanks 26 and 28 is then increased to such a magnitude that the tubular blank 26 is expanded outwardly into engagement with the recesses 18*a* and 20*a* formed in the first and second die sections 18 and 20 of the first die 16, while the second tubular blank 28 is expanded outwardly into engagement with the recesses 22*a* and 24*a* formed in the first and second die sections 22 and 24 of the second die 18. Such expansion causes the tubular members 26 and 28 to conform with the shape of the die cavities 21 and 25, respectively, as shown in FIGS. 3 and 4. Preferably, a single source provides pressurized fluid to each of the tubular blanks 26 and 28 at the same time so that the respective hydroforming processes can be performed substantially simultaneously at the same pressures. As a result, the hydroforming apparatus 10 is capable of performing two or more hydroforming operations simultaneously to decrease the overall amount of operational cycle time and, therefore, increase overall productivity. However, the hydroforming processes are essentially independent of one another and, therefore, can be performed with differing parameters, including times, pressures, and the like if desired.

Figure 5:
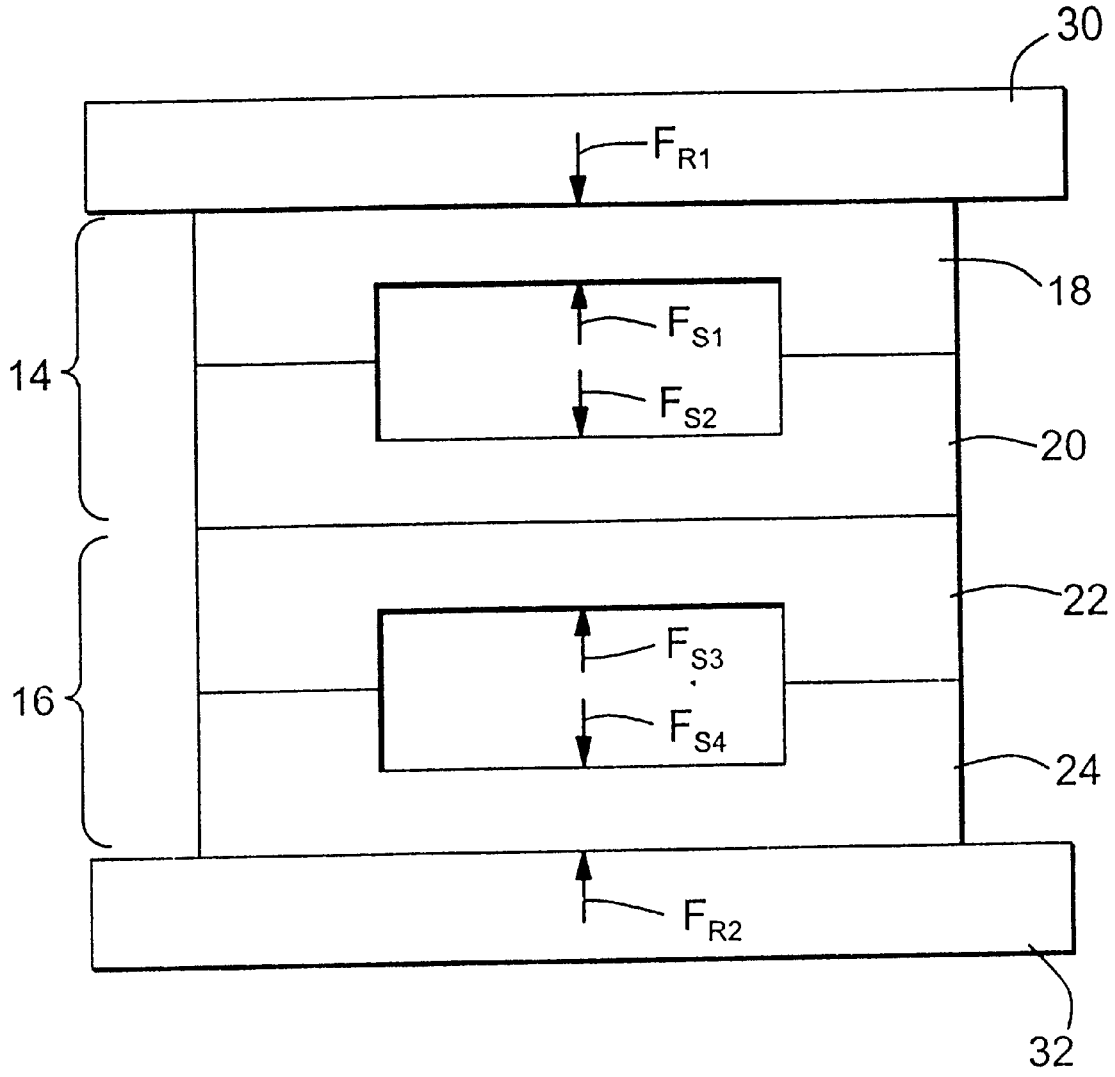
FIG. 5 is a schematic free body diagram of a portion of the hydroforming apparatus illustrated in FIGS. 1 through 4 schematically showing the distribution of forces that occur during the hydroforming process.

FIG. 5 is a free body diagram of a portion of the hydroforming apparatus 10 illustrated in FIGS. 1 through 4 schematically showing the distribution of forces that occur during the hydroforming process. As mentioned above, the introduction of pressurized fluid within each of the tubular members 26 and 28 causes them to expand outwardly into engagement with the respective dies 16 and 18. As a result, oppositely directed forces are exerted by the first tubular blank 26 against the first and second die sections 18 and 20 of the first die 16, tending to separate move them apart from one another, thereby disrupting the stacked relationship therebetween. These oppositely directed separation forces are equal in magnitude to one another and are indicated graphically at $F_{S1}$ and $F_{S2}$ FIG. 5. Similarly, oppositely directed forces are exerted by the second tubular blank 28 against the first and second die sections 22 and 24 of the second die 18, tending to separate move them apart from one another, thereby disrupting the stacked relationship therebetween. These oppositely directed separation forces are also equal in magnitude to one another and are indicated graphically at $F_{S3}$ and $F_{S4}$ in FIG. 5.

The frame 12 of the hydroforming apparatus 10 is designed with sufficient strength to absorb these separation forces $F_{S1}$ and $F_{S2}$ to prevent any relative movement from occurring between the first and second die sections 18 and 20 of the first die 16 and the first and second die sections 22 and 24 of the second die 18 and thereby maintain the illustrated stacked relationship. To accomplish this, a first reaction force $F_{R1}$ is exerted by the ram 30 of the hydroforming apparatus 10 against the first die section 18 of the first die 16. The first reaction force $F_{R1}$ is equal in magnitude and opposite in direction to the separation force $F_{S1}$ and, therefore, prevents any relative movement of the first die section 18 of the first die 16. Similarly, a second reaction force FR2 is exerted by the bed 32 of the hydroforming apparatus 10 against the second die section 24 of the second die 18. The second reaction force $F_{R2}$ is equal in magnitude and opposite in direction to the separation force $F_{S4}$ and, therefore, prevents any relative movement of the second die section 24 of the second die 18.

As mentioned above, the hydroforming processes are preferably performed on the tubular blanks 26 and 28 substantially simultaneously and at substantially the same internal pressures. In this situation, and assuming that the tubular blanks 26 and 28 are substantially the same size, then the separation forces $F_{S1}$ and $FS_2$ generated by the first tubular blank 26 are substantially equal in magnitude to the separation forces $F_{S3}$ and $FS_4$ generated by the second tubular blank 28. Thus, the separation forces $F_{S2}$ and $F_{S3}$ are substantially equal in magnitude and opposite in direction to one another Therefore, such separation forces $F_{S2}$ and $F_{S3}$ substantially cancel out one another, leaving a net force of approximately zero. Thus, for the reasons described above, the frame 12 of the hydroforming apparatus 10 must only be sufficiently strong as to be capable of absorbing the summation of the oppositely directed separation forces $F_{S1}$ and $F_{S4}$ to maintain the illustrated stacked relationship between the dies 14 and 16.

As a result of this cancellation effect, the net force exerted on the frame 12 of the hydroforming apparatus 10 is equal to the sum of the separation forces $F_{S1}$ and $F_{S4}$. This net force is no greater than would occur if a single die were provided within the hydroforming apparatus 10. Such a single die would exert separation forces that would be the same as the separation forces $F_{S1}$ and $F_{S4}$. Thus, it can be seen that by stacking the first and second dies 14 and 16 in the manner described and illustrated herein, a plurality of tubular blanks 26 and 28 can be hydroformed simultaneously without increasing the net force exerted on the frame member 12 as compared to a conventional, single die hydroforming apparatus. Such a structure, therefore, is capable of performing two or more hydroforming operations simultaneously to decrease operational cycle time and, therefore, increase overall productivity without requiring a significant increase in the capacity of the hydroforming apparatus 10.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for performing a hydroforming operation comprising:

a frame including first and second portions that define a space therebetween that extends in a first direction;

a plurality of dies supported in a stacked relationship between said first and second portions of said frame, each of said dies including a pair of die sections having respective recesses formed therein that cooperate to define a die cavity when said die sections engage one another, said die cavities extending in a second direction that is different from said first direction and adapted to receive respective tubular blanks therein; and means for supplying pressurized fluid within each of said die cavities, the pressurized fluid adapted to expand the tubular blanks into conformance with the respective die cavities.

2. The apparatus defined in claim 1 wherein said first and second portions of said frame function as a clamping mechanism to maintain said plurality of dies in said stacked relationship.

3. The apparatus defined in claim 1 wherein said first portion of said frame is movable relative to said second portion.

4. The apparatus defined in claim 1 wherein said first portion of said frame is a movable ram and said second portion of said frame is a stationary bed.

5. The apparatus defined in claim 1 wherein said plurality of dies includes a first die including first and second die sections and a second die including first and second die sections.

6. The apparatus defined in claim 5 wherein said first die section of said first die is engaged by said first portion of said frame and said second die section of said second die is engaged by said second portion of said frame.

7. The apparatus defined in claim 5 wherein said first die section of said first die is engaged by said first portion of said frame, said second die section of said first die is engaged with said first die section of said second die, and said second die section of said second die is engaged by said second portion of said frame.

8. The apparatus defined in claim 7 wherein said frame further includes a support mechanism, and wherein said second die section of said first die and said first die section of said second die are engaged by said support mechanism.

9. The apparatus defined in claim 7 wherein said second die section of said first die and said first die section of said second die are formed integrally with one another.

10. The apparatus defined in claim 1 wherein said second direction is generally transverse to said first direction.

11. A method for method of hydroforming a plurality of tubular members comprising the steps of:

(a) providing a frame including first and second portions;

(b) providing a plurality of dies in said frame, each of said dies including a pair of die sections having respective recesses formed therein that cooperate to define a die cavity when said die sections engage one another;

(c) disposing a tubular blank in each of said the cavities;

(d) orienting the dies in a stacked relationship between the first and second portions of the frame; and (e) supplying pressurized fluid within each of the die cavities so as to expand the tubular blanks into conformance with the respective die cavities.

12. The method defined in claim 11 wherein said step (a) is performed by providing the first portion of the frame as a movable ram and the second portion of the frame as a stationary bed.

13. The method defined in claim 11 wherein said step (b) is performed by providing a first die including first and second die sections and a second die including first and second die sections.

14. The method defined in claim 13 wherein said step (b) is performed by engaging the first die section of the first die with the first portion of the frame and engaging the second die section of said second die with the second portion of the frame.

15. The method defined in claim 11 wherein said step (b) is performed by engaging the first die section of the first die with the first portion of said frame, engaging the second die section of first die with the first die section of the second die, and engaging the second die section of the second die with the second portion of the frame.

16. The method defined in claim 15 wherein said step (a) is performed by providing a support mechanism that engages the second die section of the first die and the first die section of the second die.

17. The method defined in claim 15 wherein said step (b) is performed by providing forming the second die section of the first die and the first die section of the second die integrally with one another.

* * * * *